US010516226B2

(12) United States Patent
Tamai

(10) Patent No.: US 10,516,226 B2
(45) Date of Patent: Dec. 24, 2019

(54) INTERMEDIATE ELECTRICAL CONNECTOR AND ELECTRICAL CONNECTOR ASSEMBLIES

(71) Applicant: Hirose Electric Co., Ltd., Shinagawa-ku, Tokyo (JP)

(72) Inventor: Nobuhiro Tamai, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 16/295,903

(22) Filed: Mar. 7, 2019

(65) Prior Publication Data

US 2019/0280410 A1 Sep. 12, 2019

(30) Foreign Application Priority Data

Mar. 8, 2018 (JP) ..... 2018-041896

(51) Int. Cl.
*H01R 12/73* (2011.01)
*H01R 12/72* (2011.01)

(52) U.S. Cl.
CPC ..... *H01R 12/73* (2013.01); *H01R 12/721* (2013.01)

(58) Field of Classification Search
CPC ..... H01R 12/00; H01R 12/52; H01R 12/716
USPC ..... 439/74
See application file for complete search history.

(56) References Cited

U.S. PATENT DOCUMENTS 6,769,922 B1 8/2004 Lee et al.
8,485,831 B2 * 7/2013 Cipolla ..... H01R 13/6587 439/607.07
8,500,461 B2 * 8/2013 Tseng ..... H01R 12/714 439/74

* cited by examiner

*Primary Examiner* — Phuong K Dinh
(74) *Attorney, Agent, or Firm* — Procopio, Cory, Hargreaves & Savitch LLP

(57) ABSTRACT

The contact portions 22, 122 of the terminals 20, 120 of the two circuit board connectors 1 and the intermediate electrical connector 3 have leaf contact point portions 22B, 122B extending in the above-mentioned direction of connection of the connectors and protruding contact point portions 22A-1, 122A-1 located closer to the free end side of the terminals 20, 120 than to said leaf contact point portions 22B, 122B; and, in a connected state, the protruding contact point portions of the above-mentioned terminals are made contactable with the leaf contact point portions of the counterpart terminals.

12 Claims, 9 Drawing Sheets

INTERMEDIATE ELECTRICAL CONNECTOR AND ELECTRICAL CONNECTOR ASSEMBLIES

CROSS REFERENCE TO RELATED APPLICATIONS

This Paris Convention Patent Application claims benefit under 35 U.S.C. § 119 and claims priority to Japanese Patent Application No. JP 2018-041896, filed on Mar. 8, 2018, titled "INTERMEDIATE ELECTRICAL CONNECTOR AND ELECTRICAL CONNECTOR ASSEMBLIES", the content of which is incorporated herein in its entirety by reference for all purposes.

BACKGROUND

Technical Field

The present invention relates to an intermediate electrical connector mediating between a pair of electrical connectors for circuit boards, an electrical connector assembly having a plurality of said intermediate electrical connectors, and an electrical connector assembly having intermediate electrical connectors and electrical connectors for circuit boards.

Background Art

When one electrical connector for circuit boards (circuit board connector) disposed on a circuit board and another circuit board connector disposed on another circuit board are mated in a direction of connection coinciding with the direction of diametrical opposition of the circuit boards, a large distance is sometimes configured between the circuit boards in the above-mentioned direction of connection due to considerations such as the available space within the device or devices in which these circuit board connectors are disposed, etc.

It is thought that when such settings are used, it is necessary, for example, to increase circuit board connector dimensions in the above-mentioned direction of connection (heightwise direction of the connector). However, if the members that make up said circuit board connectors become larger in the above-mentioned direction of connection, there is a risk that said electrical connectors for circuit boards could become difficult to manufacture, for example, due to inadequate flow of resin material in the mold during the molding of a housing or due to the increased difficulty of pressing using a press machine when processing terminal blanks. In addition, although electrical connectors for circuit boards are often solder-connected to circuit boards by being heated in a reflow oven while being disposed on said circuit boards, if said electrical connectors for circuit boards are made larger in the above-mentioned direction of connection, there is a risk that a sufficient solder connection to the circuit boards could become impossible due to the increased overall heat capacity of the connectors. In addition, if the circuit board connectors are excessively large in the above-mentioned direction of connection, there is also a risk that it could be impossible to fit said electrical connectors for circuit boards into a reflow oven.

Accordingly, it is sometimes customary to place an intermediate electrical connector (intermediate connector) between two circuit board connectors and connect the two circuit board connectors via said intermediate connector without increasing the height dimensions of the circuit board connectors themselves. However, if the intermediate electrical connector is large in the above-mentioned direction of connection, there is a risk that said intermediate electrical connector could be difficult to manufacture for the same reasons as described above with regard to electrical connectors for circuit boards.

In view of the above, it has been a frequent practice to provide another circuit board between the two circuit boards and connect adjacent circuit boards using two electrical connectors for circuit boards and, if necessary, an intermediate connector. However, in such a connective configuration, the increased number of circuit boards and connectors used makes the connection procedure more laborious and increases costs.

Patent Document 1 discloses a connector assembly in which multiple intermediate connectors are disposed between two circuit board connectors, and the two circuit board connectors are electrically connected via said multiple intermediate connectors. If such a connective configuration is used, only the multiple intermediate connectors are disposed between the two circuit board connectors, and no circuit boards are used. For this reason, the connection procedure is correspondingly simplified and costs are reduced.

PRIOR ART LITERATURE

Patent Documents

[Patent Document 1]
U.S. Pat. No. 6,769,922

SUMMARY

Problems to be Solved

As an example, Patent Document 1 discloses an embodiment in which the contact portions of the terminals of one circuit board connector are pin-shaped and the contact portions of the terminals of another circuit board connector are hole-shaped, and, in addition, one end of the contact portions of the terminals of intermediate connectors is pin-shaped and the other end is hole-shaped. In this embodiment, two circuit board connectors are connected via multiple intermediate connectors by inserting the pin-shaped contact portions of the terminals of each connector into the hole-shaped contact portions of adjacent connectors.

When two circuit board connectors are connected via intermediate connectors, the contact portions of the terminals are not limited to the above-described pin-shaped and hole-shaped portions and there are various other conceivable shapes. A combination of typically shaped rectilinear male terminals that are not subject to resilient displacement and female terminals that are resiliently displaced and brought in contact with said male terminals is suggested as an example. In connective configurations using such male terminals and female terminals, the contact portions of the female terminals are typically brought in contact with the contact portions of said male terminals at locations spaced a certain distance from the distal ends (free ends) of the male terminals. When this distance, i.e., the so-called effective mating length, is large, a stable state of contact is ensured regardless of the mating depth of the two connectors.

However, in the section of the male terminals constituting the above-mentioned effective mating length, there is also the so-called stub. When two terminals are connected to transmit high-speed signals, the transmitted signals are reflected by said stub, which creates resonance. As a result, there is a risk that high-speed signal transmission characteristics may deteriorate, e.g., the signals to be transmitted may become weaker.

In view of these circumstances, it is an object of the present invention to provide an intermediate electrical connector and an electrical connector assembly capable of adequately preventing degradation of signal transmission quality when connecting a pair of electrical connectors for circuit boards via intermediate electrical connectors.

Technical Solution

In accordance with the present invention, the above-described problem is solved using an intermediate electrical connector according to the following first invention, and, in addition, an electrical connector assembly according to inventions 2 to 4. It is an object to provide an intermediate electrical connector and an electrical connector assembly capable of adequately preventing degradation of signal transmission quality when connecting pairs of electrical connectors for circuit boards via intermediate electrical connectors.

<First Invention>

The intermediate electrical connector according to the first invention is an intermediate electrical connector which is disposed between one electrical connector for circuit boards disposed on a circuit board and another electrical connector for circuit boards disposed on another circuit board and which is capable of connecting to these two electrical connectors for circuit boards in a direction of connection coinciding with the direction of diametrical opposition of the two circuit boards.

Such an intermediate electrical connector, in the first invention, has a plurality of connector elements arranged in an array direction parallel to the mounting faces of the circuit boards and a support supporting the above-mentioned plurality of connector elements; the above-mentioned connector elements have terminals extending in the above-mentioned direction of connection, as well as movable retainers and stationary retainers of an electrically insulating material that secure said terminals in place; the above-mentioned terminals, in the respective two end portions of said terminals in the longitudinal direction, have contact portions contactable with terminals in the electrical connectors for circuit boards; said respective contact portions are secured in place on one lateral face of individual movable retainers and are secured in place by the stationary retainers between two movable retainers; the contact portions of the terminals of the intermediate electrical connector have leaf contact point portions extending in the above-mentioned direction of connection and protruding contact point portions located closer to the free ends of the terminals than to said leaf contact point portions; and, in the connected state, the above-mentioned protruding contact point portions are made contactable with corresponding leaf contact point portions extending in the above-mentioned direction of connection that are formed on the terminals of the electrical connectors for circuit boards, and, at the same time, the above-mentioned leaf contact point portions are made contactable with corresponding protruding contact point portions located closer to the free ends of said terminals than to the above-mentioned corresponding leaf contact point portions that are formed on the terminals of the electrical connectors for circuit boards.

In the first invention, the protruding contact point portions of the terminals of the intermediate electrical connector are contactable with the corresponding leaf contact point portions of the terminals of the electrical connectors for circuit boards, and the leaf contact point portions of the terminals of the intermediate electrical connector are made contactable with the corresponding protruding contact point portions of the terminals of the electrical connectors for circuit boards. Since in the first invention the protruding contact point portions and the corresponding protruding contact point portions are provided closer to the free ends of the respective contact portions of the terminals, when contact is established between pairs of contact portions, there are no stubs, or even if there are, the stubs are extremely short. Therefore, when signals are transmitted by connecting a pair of electrical connectors for circuit boards via the intermediate electrical connector according to the first invention, stub-induced degradation of signal quality can be adequately prevented.

In the first invention, the above-mentioned terminals may have flexible portions formed between the above-mentioned movable retainers and the respective stationary retainers mentioned above. In this manner, as a result of forming the flexible portions in the terminals, the contact portions of said terminals are enabled for resilient displacement and these resiliently displaceable contact portions are brought in contact with the terminals provided in the electrical connectors for circuit boards.

In the first invention, the above-mentioned movable retainers have biasing members provided on the lateral faces opposite to the lateral faces on which the contact portions are provided. In the connected state, the above-mentioned biasing members may be adapted to apply pressure to other adjacent connector elements with a biasing force, as a result of which their reaction force brings the contact portions in contact with the terminals of the electrical connectors for circuit boards under a certain contact pressure. Thus, as a result of providing the biasing members, the contact pressure of the pairs of terminal contact portions is increased by the above-mentioned reaction force generated by said biasing members, thereby maintaining an excellent state of contact.

<Second Invention>

The invention is characterized by the fact that the electrical connector assembly according to the second invention comprises a plurality of intermediate electrical connectors according to the first invention and said intermediate electrical connectors are capable of connecting pairs of said intermediate electrical connectors.

In the second invention, a plurality of intermediate electrical connectors can be mated and coupled because the intermediate electrical connectors are made matable not only with the electrical connectors for circuit boards, but also with other intermediate electrical connectors. Therefore, pairs of circuit boards can be connected via the electrical connector assembly according to the second invention. In addition, since it is possible to couple multiple intermediate electrical connectors, even when the distances between pairs of circuit boards are configured differently for different products, the variation in distances can be easily addressed by increasing or reducing the number of intermediate electrical connectors depending on these distances. In addition, the electrical connectors can be easily manufactured because there is no need to increase the individual height dimensions (dimensions in the above-mentioned direction of connection) of the electrical connectors for circuit boards and the intermediate electrical connector.

<Third Invention>

The electrical connector assembly according to the third invention comprises an intermediate electrical connector, which is disposed between one electrical connector for circuit boards disposed on a circuit board and another electrical connector for circuit boards disposed on another circuit board and which is capable of connecting to the two electrical connectors for circuit boards in a direction of connection coinciding with the direction of diametrical opposition of the two of circuit boards, and either of the electrical connectors for circuit boards from among said two electrical connectors for circuit boards.

In such an electrical connector assembly, in the third invention, the electrical connectors for circuit boards and the intermediate electrical connector comprise a plurality of connector elements arranged in an array direction parallel to the mounting faces of the circuit boards and a support supporting the above-mentioned plurality of connector elements; the above-mentioned connector elements have terminals that extend in the above-mentioned direction of connection, as well as stationary retainers and movable retainers of an electrically insulating material that secure said terminals in place; the terminals of the electrical connectors for circuit boards have connecting portions connectable to the mounting faces at one end of said terminals in the longitudinal direction of the terminals and contact portions contactable with the terminals of the intermediate electrical connector at the other end in the longitudinal direction; said contact portions are secured in place on one lateral face of the movable retainers and are secured in place by the stationary retainers between said movable retainers and the above-mentioned connecting portions; the terminals of the intermediate electrical connector have contact portions contactable with the terminals of the electrical connectors for circuit boards in the respective two end portions of said terminals in the longitudinal direction; said respective contact portions are secured in place on one lateral face of individual movable retainers and are secured in place between two movable retainers by the stationary retainers; the contact portions of the terminals of the circuit board connectors and the intermediate electrical connector have leaf contact point portions extending in the above-mentioned direction of connection and protruding contact point portions located closer to the free end side of the terminals than to said leaf contact point portions; and, in the connected state, the protruding contact point portions of the above-mentioned terminals are made contactable with the leaf contact point portions of the counterpart terminals.

The term "counterpart terminals" means terminals provided in directly mated electrical connectors, i.e., in "counterpart connectors". For example, when the electrical connectors for circuit boards are directly mated with the intermediate electrical connector, the terminals of the intermediate electrical connector become counterpart terminals for the terminals of the electrical connectors for circuit boards and the terminals of the electrical connectors for circuit boards become counterpart terminals for the terminals of the intermediate electrical connector.

In the third invention, the protruding contact point portions of the above-mentioned terminals are made contactable with the leaf contact point portions of the counterpart terminals. That is, the protruding contact point portions of the contact portions of the above-mentioned terminals are brought in contact with the leaf contact point portions of the counterpart terminals and the protruding contact point portions of the contact portions of the counterpart terminals are brought in contact with the leaf contact point portions of the above-mentioned terminals. Since in the third invention the protruding contact point portions of both contact portions are provided closer to the free end side of said contact portions, when a pair of contact portions are in contact, there are no stubs, or even if there are, the stubs are extremely short. Therefore, when signals are transmitted using the electrical connector assembly according to the third invention, stub-induced degradation of signal quality can be adequately prevented.

In the third invention, the terminals of the electrical connectors for circuit boards may have a flexible portion formed between the movable retainers and the stationary retainers securing said terminals in place, and the terminals of the intermediate electrical connector may have a flexible portion formed between the movable retainers and the respective stationary retainers securing said terminals in place.

In the third invention, the movable retainers of the electrical connectors for circuit boards and the intermediate electrical connector have biasing members provided on the lateral face opposite to the face on which the contact portions are provided. In the connected state, the above-mentioned biasing members may be adapted to apply pressure to other adjacent connector elements with a biasing force, as a result of which their reaction force brings the contact portions in contact with the counterpart terminals under a certain contact pressure.

In the third invention, a plurality of intermediate electrical connectors may be provided and said intermediate electrical connectors may be capable of connecting pairs of said intermediate electrical connectors.

<Fourth Invention>

The electrical connector assembly according to the fourth invention is an electrical connector assembly in which one electrical connector for circuit boards disposed on a circuit board and another electrical connector for circuit boards disposed on another circuit board can be connected via an intermediate electrical connector disposed between the two electrical connectors for circuit boards in a direction of connection coinciding with the direction of diametrical opposition of the two circuit boards.

In such an electrical connector assembly, in the fourth invention, the two electrical connectors for circuit boards and the intermediate electrical connector comprise a plurality of connector elements arranged in an array direction parallel to the mounting faces of the circuit boards and a support supporting the above-mentioned plurality of connector elements; the above-mentioned connector elements have terminals that extend in the above-mentioned direction of connection, as well as stationary retainers and movable retainers of an electrically insulating material that secure said terminals in place; the terminals of the two electrical connectors for circuit boards have connecting portions connectable to the mounting faces at one end of said terminals in the longitudinal direction and contact portions contactable with the terminals of the intermediate electrical connector at the other end in the longitudinal direction; said contact portions are secured in place on one lateral face of the movable retainers and are secured in place by the stationary retainers between said movable retainers and the above-mentioned connecting portions; the terminals of the intermediate electrical connector have contact portions contactable with the terminals of the electrical connectors for circuit boards in the respective two end portions of said terminals in the longitudinal direction; said respective contact portions are secured in place on one lateral face of individual movable retainers and are secured in place between two of movable retainers by the stationary retainers; the contact portions of the terminals of the two circuit board connectors and the intermediate electrical connector have leaf contact point portions extending in the above-mentioned direction of connection and protruding contact point portions located closer to the free end side of the terminals than to said leaf contact point portions; and, in the connected state, the protruding contact point portions of the above-mentioned terminals are made contactable with the leaf contact point portions of the counterpart terminals.

In the fourth invention, in the same manner as in the third invention, the protruding contact point portions of the contact portions of the above-mentioned terminals are brought in contact with the leaf contact point portions of the counterpart terminals and the protruding contact point portions of the contact portions of the counterpart terminals are brought in contact with the leaf contact point portions of the above-mentioned terminals. Since in the fourth invention the protruding contact point portions of both contact portions are also provided closer to the free end side of said contact portions, when a pair of contact portions are in contact, there are no stubs, or even if there are, the stubs are extremely short. Therefore, when signals are transmitted using the electrical connector assembly according to the fourth invention, stub-induced degradation of signal quality can be adequately prevented.

In the fourth invention, the terminals of the two electrical connectors for circuit boards may have a flexible portion formed between the movable retainers and the stationary retainers securing said terminals in place, and the terminals of the intermediate electrical connector may have a flexible portion formed between the movable retainers and the respective stationary retainers securing said terminals in place.

In the fourth invention, the movable retainers of the two electrical connectors for circuit boards and the intermediate electrical connector have biasing members provided on the lateral faces opposite to the faces on which the contact portions are provided. In the connected state, the above-mentioned biasing members may be adapted to apply pressure to other adjacent connector elements with a biasing force, as a result of which their reaction force brings the contact portions in contact with the counterpart terminals under a certain contact pressure.

In the fourth invention, a plurality of intermediate electrical connectors may be provided and said intermediate electrical connectors may be capable of connecting pairs of said intermediate electrical connectors.

Effects of the Invention

Since in the present invention, as described above, the terminals of mutually mated electrical connectors have said protruding contact point portions provided closer to the free end side of said contact portions, when a pair of contact portions are in contact, there are no stubs, or even if there are, the stubs are extremely short. Therefore, when signals are transmitted by connecting two electrical connectors for circuit boards via an intermediate electrical connector, stub-induced degradation of signal quality can be adequately prevented.

DETAILED DESCRIPTION

Embodiments of the present invention will be described below with reference to the accompanying drawings.

Figure 1:
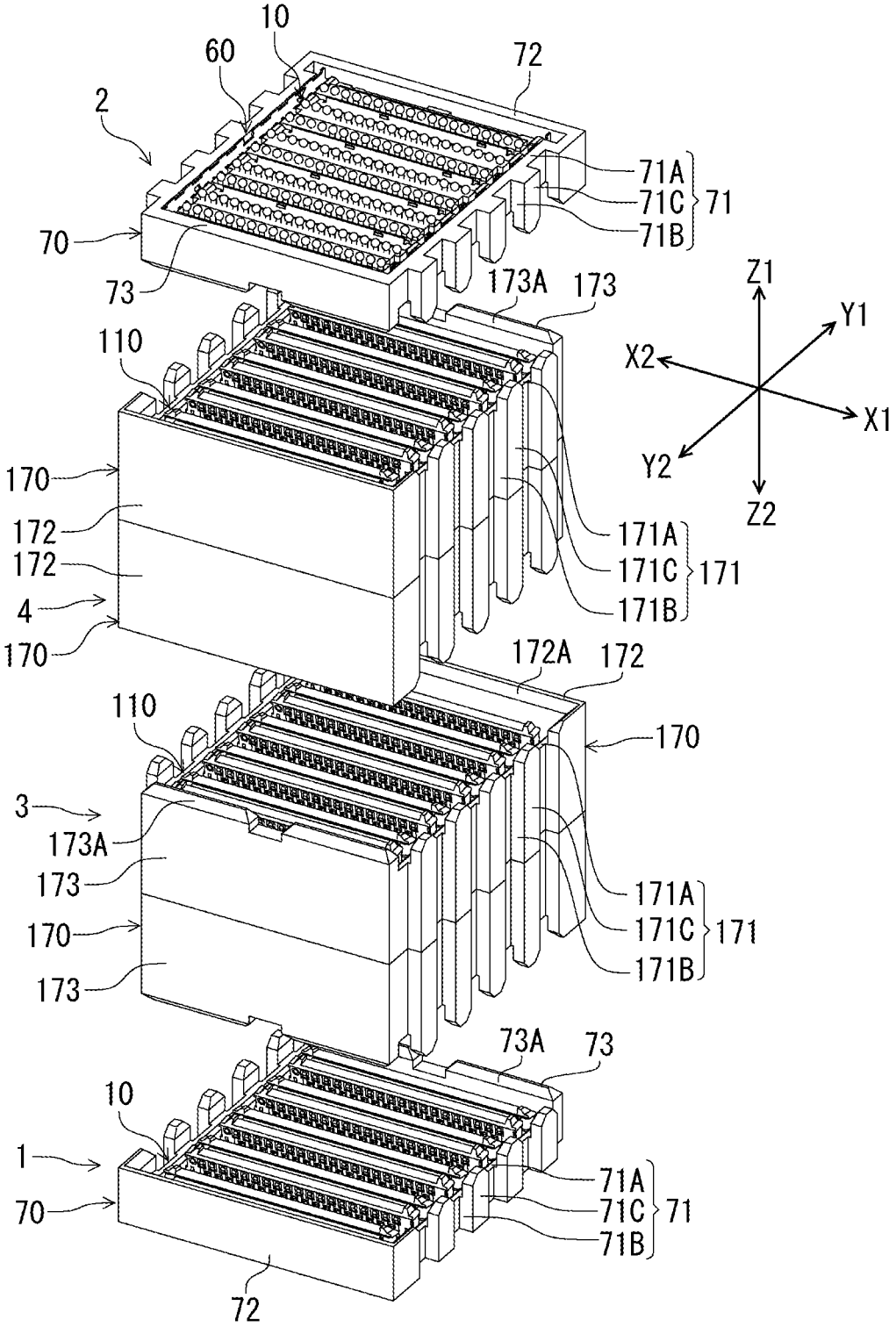
FIG. 1 An overall perspective view of an electrical connector assembly according to an embodiment of the present invention illustrating a state prior to mating.
Figure 2:
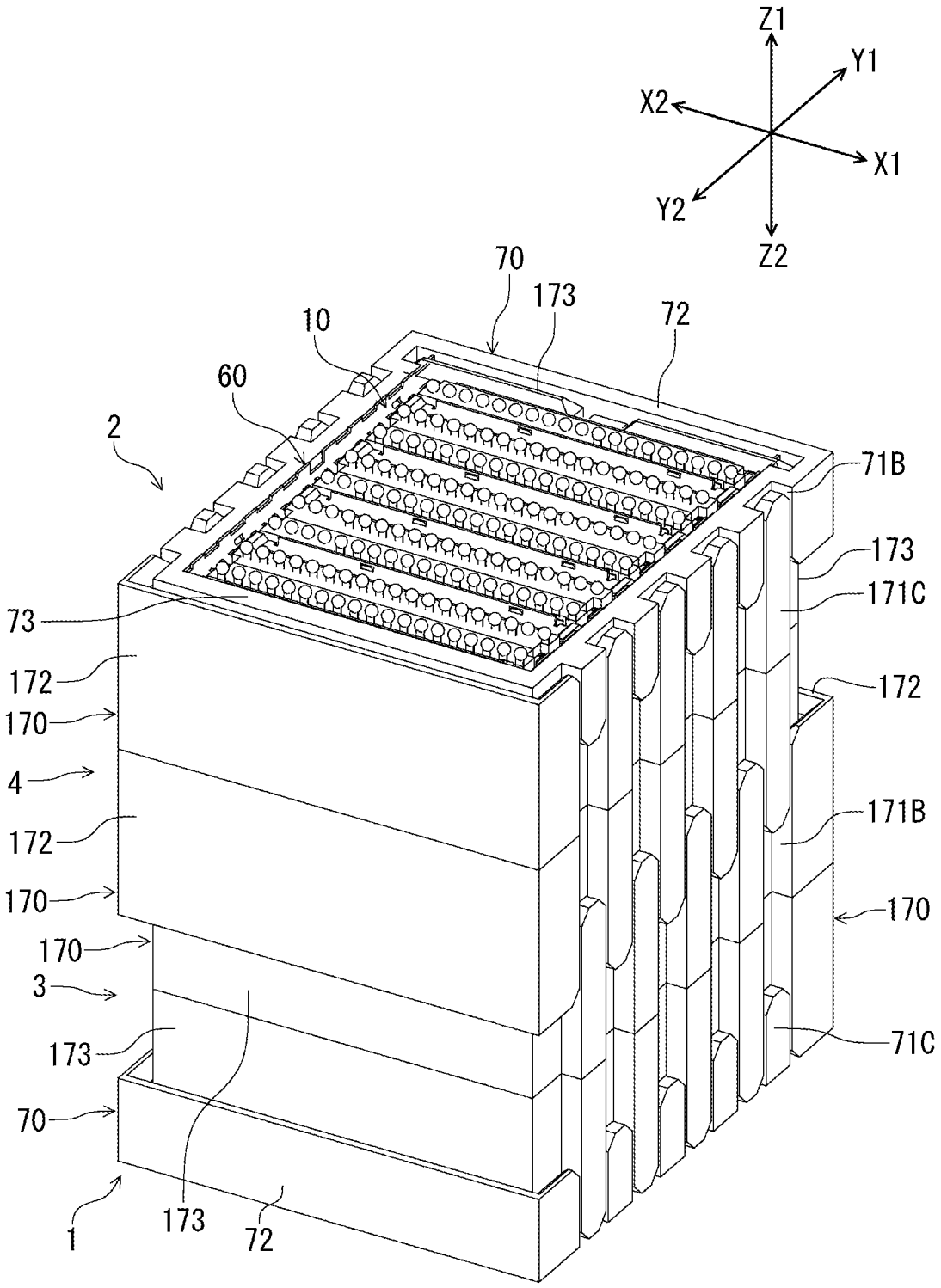
FIG. 2 An overall perspective view of the electrical connector assembly of FIG. 1 illustrating a state after mating.
Figure 3:
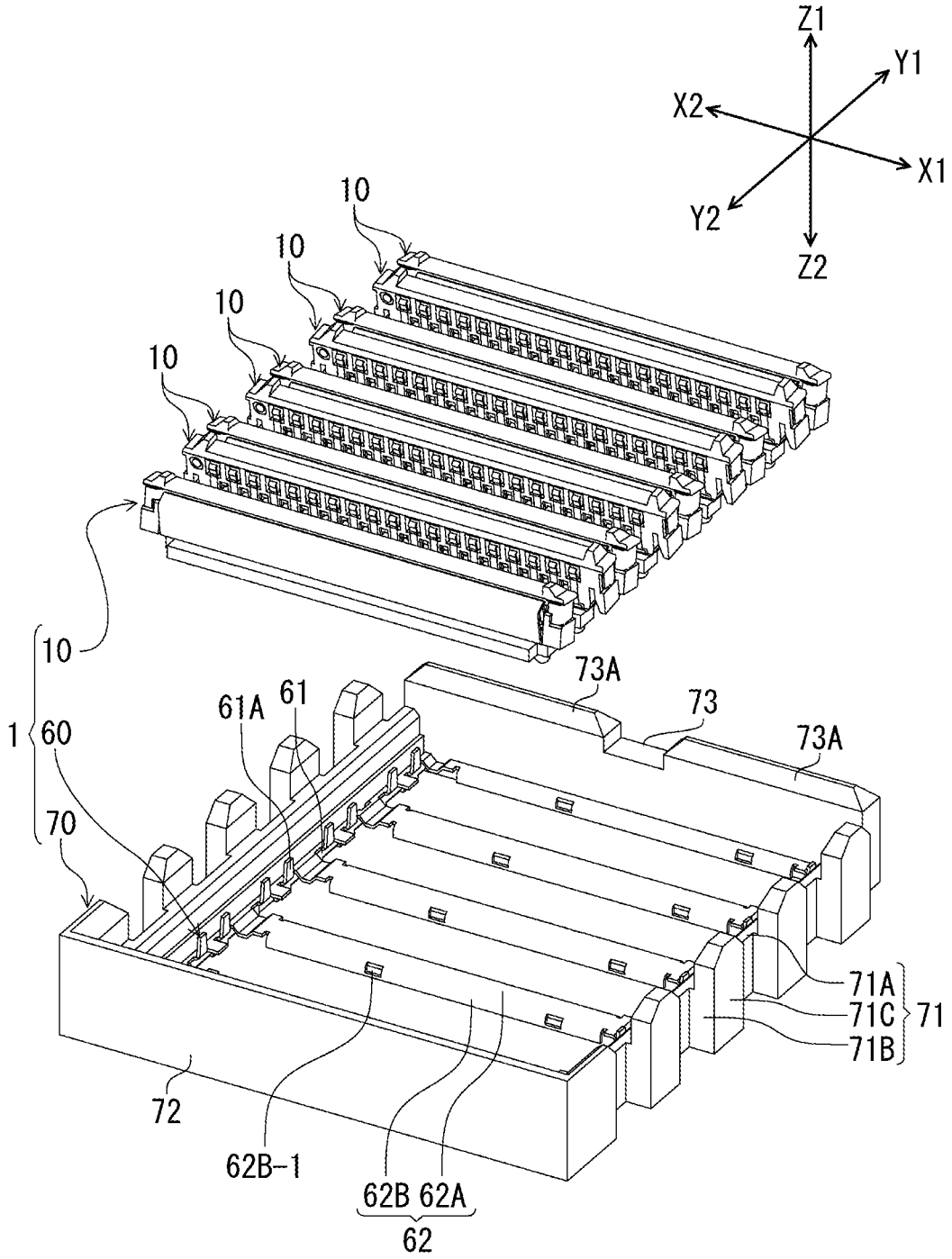
FIG. 3 A perspective view illustrating the connector elements of the electrical connector for circuit boards of FIG. 1 separately from the support and coupling member.

FIG. 1 and FIG. 2 are perspective views illustrating an electrical connector assembly according to the present embodiment, wherein FIG. 1 illustrates the electrical connector assembly before mating and FIG. 2 after mating. FIG. 3 is a perspective view in which the connector 1 is shown with the hereinafter-described connector elements separated from the support and coupling member. The connectors 1 and 2 are electrical connectors for circuit boards disposed on the mounting faces of different circuit boards (not shown) and are connected in a direction of connection coinciding with the direction of diametrical opposition of the two circuit boards (Z-axis direction in FIGS. 1 and 2) via two intermediate electrical connectors 3, 4 (hereinafter referred to as "intermediate connectors") disposed between the two connectors 1, 2. In the present embodiment, the connectors 1 and 2 have the same shape. In addition, the intermediate connectors 3 and 4 have the same shape.

The connector 1 has multiple (in this embodiment, nine) connector elements 10 (see FIG. 3), which have a substantially rectangular parallelepiped-like external configuration extending in a single longitudinal direction (Y-axis direction in FIGS. 1 to 3) parallel to the above-mentioned mounting face and are arranged in an array direction coinciding with said longitudinal direction, a coupling member 60 of sheet metal extending in the above-mentioned array direction (Y-axis direction) throughout the array range of the above-mentioned multiple connector elements 10, which couples and retains in place said multiple connector elements 10 (see FIG. 3), and a support 70 made of an electrically insulating material, which has a frame-like shape that is substantially square when viewed in the vertical direction, and which houses and supports the multiple connector elements 10 coupled and secured in place by the above-mentioned coupling member 60.

Figure 4:
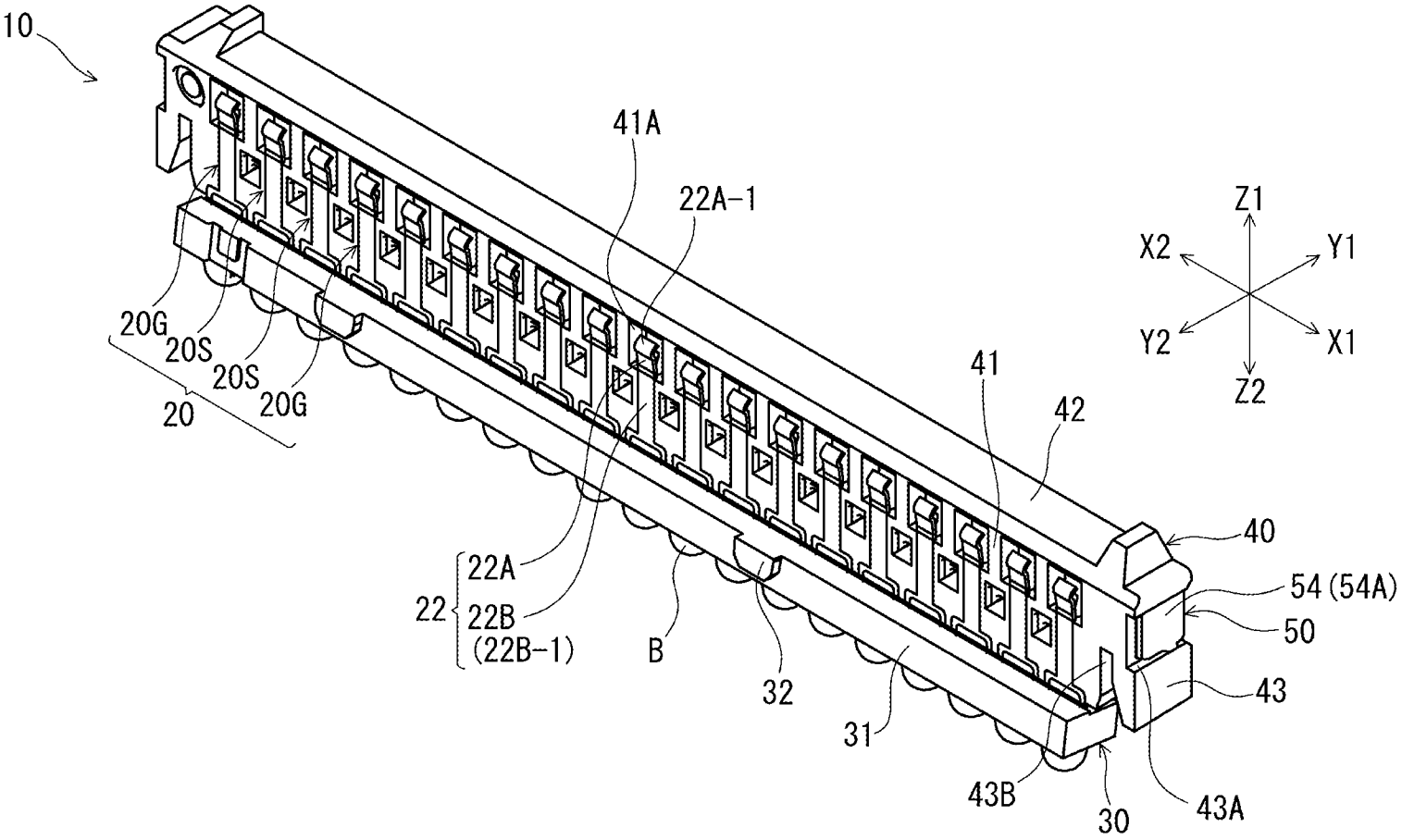
FIG. 4 An overall perspective view of a single connector element.

FIG. 4 is an overall perspective view illustrating a single connector element 10. Said connector element 10 has multiple sheet metal terminals 20, which are arranged in a terminal array direction coinciding with the connector-width direction (X-axis direction), i.e., the transverse direction of the connector 1, two retainers made of an electrically insulating material (the hereinafter-described stationary retainer 30 and movable retainer 40), whereby said multiple terminals 20 are retained in place in array form by unitary co-molding, and a sheet metal member 50 serving as a biasing member, which is disposed extending over the terminal array range in the connector-width direction. As can be seen in FIG. 3, in the present embodiment, a single connector element 10 is located at one end (side Y2) in this array direction (Y-axis direction), while other connector elements are provided in pairs of two symmetrically grouped connector elements 10.

In the connector 1, the spaces between two pairs of connector elements 10 adjacent in the above-mentioned array direction and, in addition, the spaces between the connector element 10 disposed at the outermost position in the above-mentioned array direction and the hereinafter-described end walls 72, 73 of the support 70 are formed as a receiving portion R1 used for receiving the connector elements 10 of the connector 2 (see FIG. 7).

The retainers securing the terminals 20 in place include a stationary retainer 30, which collectively secures in place the hereinafter-described stationary-side retained portions 23B of all the terminals 20 provided in a single connector element 10 using unitary co-molding, and a movable retainer 40, which collectively secures in place the hereinafter-described movable-side retained portions 23C and upper retained portions 24 of all the above-mentioned terminals 20 using unitary co-molding and is capable of relative angular displacement with respect to the stationary retainer 30 such that the connector-width direction (X-axis direction) is the axis of revolution.

As can be seen in FIG. 4, when the connector 1 is disposed on and connected to a circuit board, the stationary retainer 30 of the connector 1, which is located closer to said circuit board, extends in the connector-width direction (X-axis direction) and, in addition, the movable retainer 40, which extends in parallel to said stationary retainer 30 in said connector-width direction, is provided in a spaced relationship to the above-mentioned stationary retainer 30 in the vertical direction (Z-axis direction), i.e., in the height direction of the connector, at an upper location (on side Z1) positioned farther away from the above-mentioned circuit board than the stationary retainer 30. For example, as can be seen in FIG. 7, the vertical (Z-axis direction) dimensions of the stationary retainer 30 in the shape of a cross-section perpendicular to the connector-width direction are smaller than its width dimensions in the array direction (Y-axis direction) of the connector elements 10. By contrast, in the movable retainer 40, its dimensions in the vertical direction are larger than its width dimensions. The stationary retainer 30 and the movable retainer 40 will be discussed again below.

Figure 5:
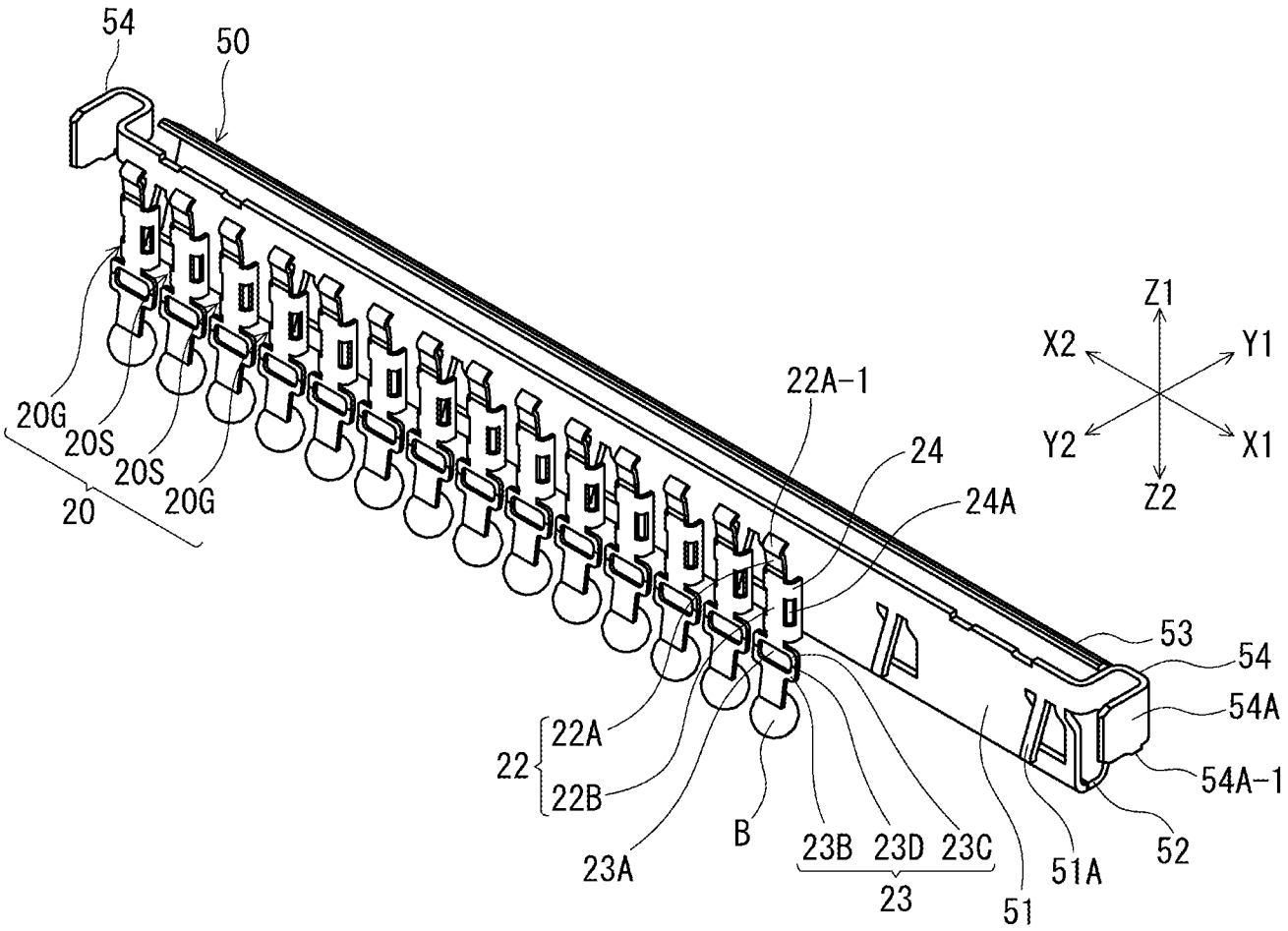
FIG. 5 An oblique view illustrating only the terminals and the sheet metal member of the connector element of FIG. 4.

FIG. 5 is an oblique view that illustrates only the terminals 20 and the sheet metal member 50 with the stationary retainer 30 and the movable retainer 40 omitted from the connector element 10 of FIG. 4. In addition, in this FIG. 5, some of the terminals 20 (several terminals 20 on side X1 in the connector-width direction) have been omitted to illustrate the hereinafter-described resilient strips of the sheet metal member 50. As can be seen in FIG. 5, the terminals 20 are obtained when metal strip-like pieces, which extend such that their longitudinal direction is a direction parallel to the vertical direction, are partially bent in the through-thickness direction, and the major faces thereof (surfaces perpendicular to the through-thickness direction), with the exception of the hereinafter-described upper retained portion 24, are arranged extending in the connector-width direction. As can be seen in FIG. 7, said terminals 20 pass through the stationary retainer 30 in the vertical direction and are located on the lateral faces of the movable retainer 40 that form the outward lateral faces of a pair of connector elements 10 facing each other (in the Y-axis direction), and are secured in place using unitary co-molding by the stationary retainer 30 and movable retainer 40. It should be noted that in FIG. 7, cross-hatching in the cross-section of the terminals of each connector was omitted.

As can be seen in FIG. 4 and FIG. 5, in this embodiment, some terminals 20 among the multiple terminals 20 secured in place in array form in the connector elements 10 are used as signal terminals 20S while the remaining terminals 20 are used as ground terminals 20G. Said signal terminals 20S and said ground terminals 20G are arranged in a predetermined order. In this embodiment, the ground terminals 20G are arranged so as to be located on both sides of a pair of mutually adjacent signal terminals 20S, and mutually paired high-speed differential signals are transmitted by the above-mentioned two signal terminals 20S. Below, when the terminals 20 need to be described by distinguishing between the signal terminals 20S and ground terminals 20G, a letter "S" is attached to the reference numerals of each component of the signal terminals 20S and a letter "G" is attached to the reference numerals of each component of the ground terminals 20G.

As can be seen in FIG. 5, said terminals 20 have connecting portions 21 (see FIGS. 6 and 7) at their lower end (at one end on side Z2) solder-connected to the circuitry on the mounting face of the circuit board (not shown) and contact portions 22 at their upper end (at the other end on side Z1) intended for contact with the hereinafter-described terminals 20 provided in the intermediate connector 3. Furthermore, the terminals 20 also have lower retained portions 23 (see also FIGS. 6 and 7), which are secured in place by the stationary retainer 30 and the movable retainer 40 between the connecting portions 21 and the contact portions 22, and upper retained portions 24 (see FIG. 5), which extend from the lateral edges extending in the vertical direction on both sides of the contact portions 22 and are secured in place by the movable retainer 40.

Figure 6:
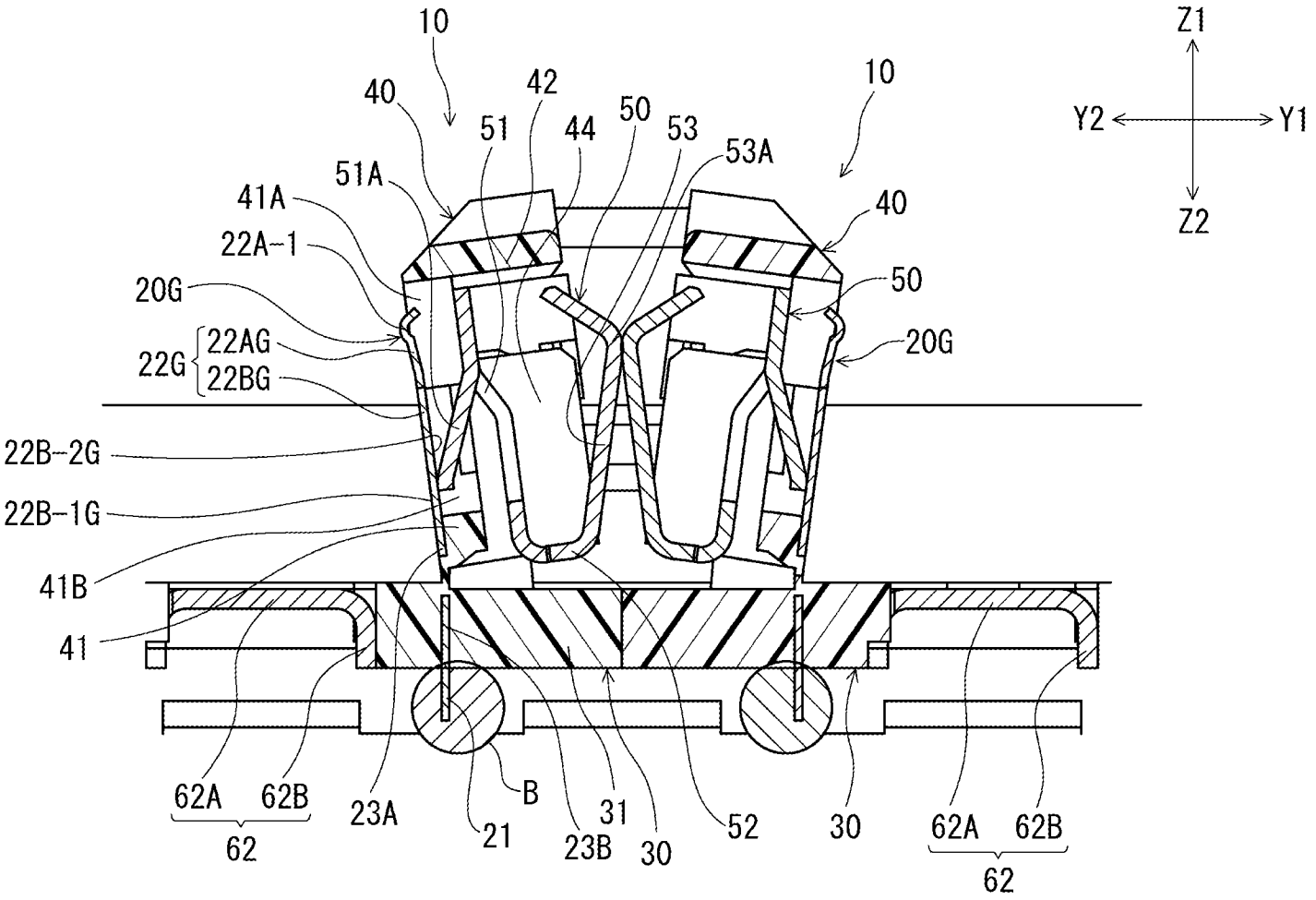
FIG. 6 A cross-sectional view of a pair of adjacent connector elements taken along a plane perpendicular to the connector-width direction, which illustrates a cross-section of grounding terminals in the connector-width direction.
Figure 7:
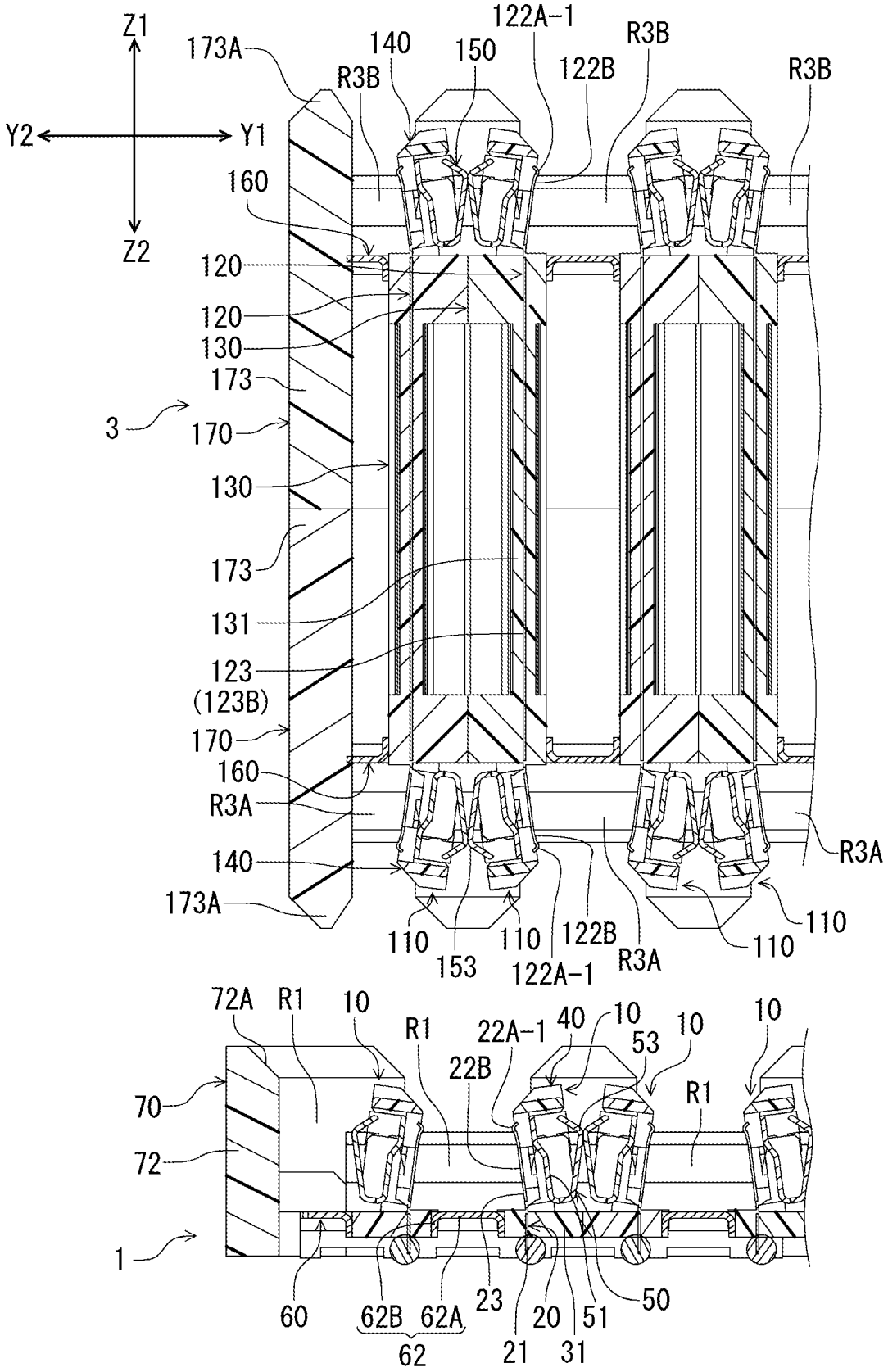
FIG. 7 A partial cross-sectional view of an electrical connector for circuit boards and an intermediate electrical connector prior to connector mating taken along a plane perpendicular to the connector-width direction, which illustrates a cross-section of signal terminals in the connector-width direction.

As can be seen in FIG. 6 and in FIG. 7, the connecting portions 21 have a rectilinear configuration extending in the vertical direction, protrude from the bottom face of the stationary retainer 30, and have attached thereto solder balls B used for solder connection to a circuit board.

Figure 8:
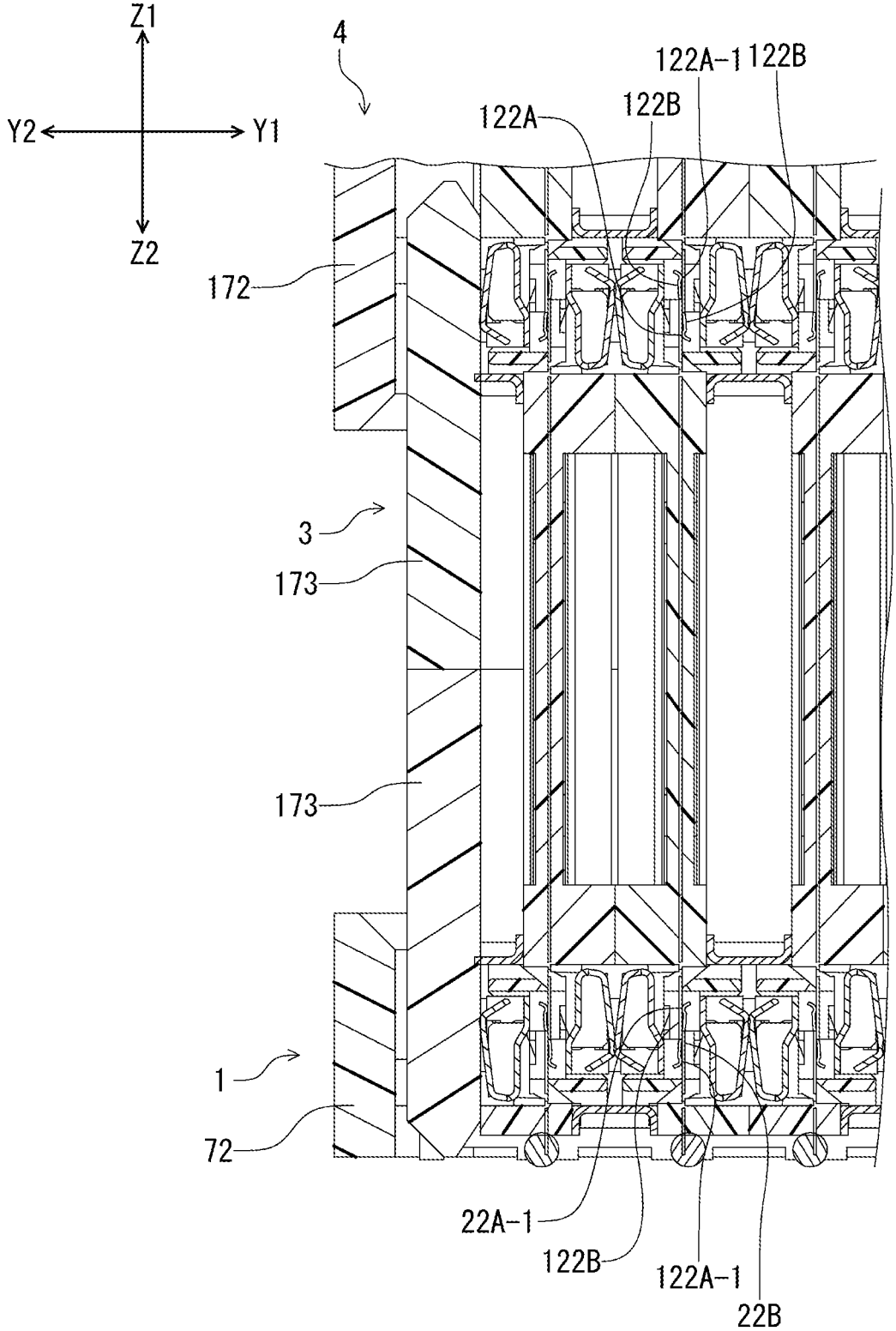
FIG. 8 A cross-sectional view illustrating the connector and intermediate electrical connector of FIG. 7 in a state after connector mating.

As can be seen in FIG. 4, the contact portions 22 extend along one lateral face of the movable retainer 40 such that their major faces (faces perpendicular to their through-thickness faces) are exposed on the above-mentioned lateral face throughout its entire vertical extent. The exposed major faces serve as contact surfaces intended for contact with counterpart terminals. Specifically, said contact portions 22 have formed therein contact pieces 22A provided with protruding contact point portions 22A-1 having a raised bump shape at their upper ends as well as strip-shaped leaf contact point portions 22B located below said contact pieces 22A. In other words, the protruding contact point portions 22A-1 are located closer to the free end side (upper end side) of the terminals 20 than the leaf contact point portions 22B. As can be seen in FIG. 4, the above-mentioned contact pieces 22A are positioned in alignment with the hereinafter-described openings permitting resilient displacement 41A of the above-mentioned movable retainer 40 and are capable of resilient displacement in the through-thickness direction. As can be seen in FIG. 8, the protruding contact point portions 22A-1 of the terminals 20 of the connector 1 are adapted to be brought in contact with the leaf contact point portions 22B of the intermediate terminals 120 (counterpart terminals for terminals 20) of the intermediate connector 3, and the leaf contact point portions 22B of the terminals 20 of the connector 1 are adapted to be brought in contact with the protruding contact point portions 22A-1 of the intermediate terminals 120 of the intermediate connector 3. Shaping the contact portions 22 in this manner makes it possible to form an electrically simple rectilinear transmission path and produce a so-called stubless configuration that has no stubs. As a result, degradation of signal transmission quality can be adequately prevented when transmitting high-speed signals. It should be noted that in FIG. 8, cross-hatching in the cross-section of the terminals of each connector was omitted.

In addition, as can be seen in FIG. 6, if the terminals 20 are used as grounding terminals 20G, the major faces on the side opposite to the contact surfaces 22B-1G of the leaf contact point portions 22BG of said grounding terminals 20G, as described hereafter, serve as pressure surfaces 22B-2G brought in contact with said resilient strips 51A under the action of the pushing force of the resilient strips 51A of the sheet metal member 50.

As can be seen in FIG. 5, the lower retained portions 23 are formed to have a greater width in the connector-width direction (X-axis direction) than the connecting portions 21 and the contact portions 22, and, at the same time, lower openings 23A, which pass therethrough in the through-thickness direction, are formed in their central area. In this manner, forming the lower openings 23A makes it possible for molten electrically insulating material to flow into and harden in said lower openings 23A when the lower retained portions 23 are unitarily co-molded with the stationary retainer 30 and the movable retainer 40, thereby rigidly securing the lower retained portions 23 in place.

In the lower retained portions 23, their bottom halves constitute stationary-side retained portions 23B, which are secured in place by unitary co-molding with the stationary retainer 30, and their top halves constitute movable-side retained portions 23C, which are secured in place by unitary co-molding with the movable retainer 40. In addition, the sections located between the stationary-side retained portions 23B and the movable-side retained portions 23C in the lower retained portions 23 are not secured in place by the stationary retainer 30 or by the movable retainer 40. Said sections, which are made locally thinner than other portions, are formed as flexible portions 23D facilitating resilient flexure in the through-thickness direction (Y-axis direction) of said lower retained portions 23.

In addition, although in the present embodiment resin is adapted to flow into and harden in the lower openings 23A, as an alternative, for example, the stationary retainer 30 may be adapted to secure in place only the sections of the lower retained portions 23 that form the bottom edges of the lower openings 23A, and the movable retainer 40 may be adapted to secure in place only the sections that form the top edges of the lower openings 23A. In such a secured configuration, the sections of the lower retained portions 23 located in the range of the lower openings 23A in the vertical direction are not secured in place by the stationary retainer 30 or by said movable retainer 40 and are adapted to serve as resiliently displaceable flexible portions at a location between the stationary retainer 30 and said movable retainer 40. As a result, said flexible portions become larger and more prone to resilient displacement in the vertical direction, which makes it possible to ensure a larger extent of floating.

In the two lateral edges of the leaf contact point portions 22B of the above-mentioned contact portions 22, the upper retained portions 24 are bent toward the sheet metal member 50 and extend in the array direction (Y-axis direction) of the above-mentioned connector elements 10. As can be appreciated by comparing FIG. 4 and FIG. 5, the upper retained portions 24 are secured in place by unitary co-molding with the movable retainer 40, and are embedded within the thickness range of said movable retainer 40. Said upper retained portions 24 have upper openings 24A, which pass therethrough in the through-thickness direction, formed at intermediate locations in the vertical direction. Thus, as a result of forming the upper openings 24A, when the upper retained portions 24 are unitarily co-molded with the movable retainer 40, the molten electrically insulating material flows into and hardens in said upper openings 24A, such that the upper retained portions 24 are rigidly secured in place.

As discussed before, if the terminals 20 are used as grounding terminals 20G, as can be seen in FIG. 6, the pressure surfaces 22B-2G (major faces on the side opposite to the contact surfaces 22B-1G) of the leaf contact point portions 22BG are acted upon by the pushing force of the resilient strips 51A of the sheet metal member 50. In the present embodiment, the upper retained portions 24G located within the range of said leaf contact point portions 22BG in the vertical direction are rigidly secured in place by the movable retainer 40, and, for this reason, said leaf contact point portions 22BG, which are acted upon by the pushing force of the above-mentioned resilient strips 51A, can be adequately prevented from disengaging from the movable retainer 40. As a result, an excellent state of contact can be maintained between the terminals 20 and the intermediate terminals 120 (counterpart terminals) of the intermediate connector 3.

Since in the present embodiment the upper retained portions 24 are formed such that they are bent at the lateral edges of the leaf contact point portions 22B and extend toward the above-mentioned sheet metal member 50, the dimensions of the terminals 20 in the connector-width direction, in other words, the width dimensions of the terminals, are not increased and, as a result, the pairs of terminals 20 are closely spaced, which can make the connector more compact in the connector-width direction.

As can be seen in FIG. 4, the stationary retainer 30 has a stationary-side retaining portion 31, which extends in the connector-width direction (X-axis direction) and secures in place the stationary-side retained portions 23B of the terminals 20 (see FIG. 8) by unitary co-molding, and multiple protrusions 32 of a generally rectangular prismatic shape protruding from one lateral face (flat face located on side Y2 in FIG. 4 and perpendicular to the Y-axis direction) of said stationary-side retaining portion 31.

As can be seen in FIG. 4, the protrusions 32 are formed on the above-mentioned lateral face of the stationary-side retaining portion 31 at two locations spaced apart in the central area in the connector-width direction. Said protrusions 32 are adapted to be push-fitted into engagement openings 62B-1 in the hereinafter-described bottom plate portion 62 of the coupling member 60 and engaged with said engagement openings 62B-1 in the vertical direction and in the connector-width direction.

As can be seen in FIG. 4, the movable retainer 40 is made larger than the stationary retainer 30 in the connector-width direction. Said movable retainer 40 has a plate-shaped movable-side retaining portion 41, which extends over the entire terminal array range in the connector-width direction, a top wall portion 42, which protrudes from the upper end of said movable-side retaining portion 41 in the array direction (Y-axis direction) of connection element 10 toward the sheet metal member 50 (side Y1 in connection element 10 of FIG. 4) and extends in the connector-width direction (see also FIG. 6), and mounting wall portions 43, which are located on both sides of the top wall portion 42 and the movable-side retaining portion 41 in the connector-width direction.

The movable-side retaining portion 41 has a plate-like configuration having major faces intersecting with the above-mentioned array direction, and, as can be seen in FIG. 4, secures in place the leaf contact point portions 22B and the upper retained portions 24 such that the contact surfaces 22B-1 (major faces) of said leaf contact point portions 22B of the terminals 20 are exposed on one major face in the above-mentioned array direction (major face on side Y2 in FIG. 4). In addition, the movable-side retaining portion 41 has formed therein openings permitting resilient displacement 41A, which pass through said movable-side retaining portion 41 in the through-thickness direction at locations corresponding to the contact pieces 22A of the terminals 20 in the connector-width direction and in the vertical direction. Said openings permitting resilient displacement 41A are adapted to permit resilient displacement of said contact pieces 22A in the through-thickness direction when the contact pieces 22A are brought in contact with counterpart terminals. In addition, in the movable-side retaining portion 41, resilient strip-receiving openings 41B, which extend throughout a range corresponding to the leaf contact point portions 22B of the terminals 20 in the vertical direction and pass through said movable-side retaining portion 41 in the through-thickness direction, are formed at locations corresponding to the terminals 20 below the above-mentioned openings permitting resilient displacement 41A (see FIG. 6). As can be seen in FIG. 6, said resilient strip-receiving openings 41B are openings intended to receive the hereinafter-described resilient strips 51A of the sheet metal member 50 at the location of the grounding terminals 20G. Said resilient strip-receiving openings 41B have one opening in the above-mentioned through-thickness direction sealed by the leaf contact point portion 22B of the terminal 20.

As can be seen in FIG. 4, at the upper ends of the mounting wall portions 43, said mounting wall portions 43 have formed therein mounting portions 43A, which are recessed into the exterior wall surfaces located on the outward sides in the connector-width direction (X-axis direction) and form recesses open to both sides of the connector element 10 in the array direction (Y-axis direction). As described hereafter, the mountable plate portions 54A of the sheet metal member 50 are adapted to be press-fitted into said mounting portions 43A in the above-mentioned array direction (see FIG. 4). In addition, at locations inward of the above-mentioned mounting portions 43A in the connector-width direction, the mounting wall portions 43 have formed therein slit-like groove portions 43B open downwardly and to both sides in the above-mentioned array direction. As described hereafter, said groove portions 43B are adapted to receive the upright pieces 61A of the coupling member 60 from below. In addition, the above-mentioned mounting portions are not limited to recesses and, for example, may be formed as through-openings disposed in the above-mentioned array direction.

In the movable retainer 40, a space formed by the movable-side retaining portion 41, the top wall portion 42, and the mounting wall portions 43 is formed as a holding portion 44 used to hold part of the sheet metal member 50 (see FIG. 6).

As can be seen in FIG. 5, the sheet metal member 50 is made by bending a metal sheet in the through-thickness direction thereof and has a ground portion (ground plate) 51, which serves as a parallel plate portion extending in the connector-width direction and in the vertical direction; a curved portion 52, which is bent and folded back upwardly at the bottom edge of said ground portion 51; a plate-shaped biasing portion 53, which extends upwardly from said curved portion 52 along the above-mentioned ground portion 51 and faces said ground portion 51; and mountable portions 54 extending from the top of the ground portion 51 on both sides. It should be noted that while in the present embodiment the above-mentioned parallel plate portion is used as a ground portion, using it as a ground portion is not essential.

The ground portion 51 extends over the entire range of the terminal array in the connector-width direction as can be seen in FIG. 5 and, at the same time, extends over a range that includes all the contact portions 22 of the terminals 20 in the vertical direction as can be seen in FIG. 6, and is held within the holding portion 44 of the movable retainer 40 (see FIG. 6). Thus, the ground portion 51 disposed across the terminal array range serves also as a shielding plate. In addition, as can be seen in FIG. 6, said ground portion 51 is bent in the through-thickness direction in a substantially crank-like configuration, and in the array direction of the connection elements 10, its top portion is in close proximity to the movable-side retaining portion 41 of the movable retainer 40 and its bottom portion is spaced apart from said movable-side retaining portion 41. As can be seen in FIG. 6, the above-mentioned top portion of the ground portion 51 is formed in the vertical direction in a range that comprises the protruding contact point portions 22A-1 of the terminals 20.

In addition, as can be seen in FIG. 5, at locations corresponding to the ground terminals 20G in the connector-width direction, the ground portion 51 has formed therein resilient strips 51A intended to contact with the pressure surfaces 22B-2G (see FIG. 6) of said ground terminals 20G. Said resilient strips 51A are formed by cutting out and raising sections of the ground portion 51 toward the terminals 20, thereby forming cantilevered tongues that extend downward at an incline toward the terminals 20. As can be seen in FIG. 6, said resilient strips 51A enter and extend into the resilient strip-receiving openings 41B of the movable-side retaining portion 41, and are brought in contact with the pressure surfaces 22B-2G of the ground terminals 20G at their lower ends while applying contact pressure thereto. In addition, the above-mentioned resilient strips 51A are not limited to the locations shown in FIG. 5 and can be formed at any location in the connector-width direction, and the terminals 20 provided in alignment with the locations of said resilient strips 51A are used as ground terminals 20G. In other words, ground terminals 20G can be selectively configured among the multiple terminals 20.

As can be seen in FIG. 6, after extending upward at an incline while moving away from the ground portion 51, the biasing portion 53 is bent back toward the ground portion 51 at a location proximal its upper end, and its distal end (free end) is positioned within the holding portion 44 of the movable retainer 40. The bent section forms a biasing protrusion 53A protruding toward the side opposite to the ground portion 51 and, as can be seen in FIG. 6, in a connected state, as described below, the biasing portions 53 provided in adjacent connection elements 10 push against each other with two biasing protrusions 53A, as a result of which their reaction force brings the contact portions 22 of the terminals 20 in contact with intermediate terminals 120 (counterpart terminals) of intermediate connector 3 while applying contact pressure thereto.

As can be seen in FIG. 5, after having been bent in the top portions of the lateral edges located on both sides of the ground portion 51 in the connector-width direction toward the biasing portion 53 and extended in the above-mentioned array direction, the mountable portions 54 are then formed by being folded back. Therefore, when viewed in the vertical direction, said mountable portions 54 are formed to have a U-shaped configuration open toward the terminals 20 (side Y2 in FIG. 5) in the array direction (Y-axis direction) of the connection element 10. In said mountable portions 54, plate portions located on the outward sides in the connector-width direction, that is, plate portions extending toward the terminals 20 in the above-mentioned array direction, serve as mountable plate portions 54A that are press-fitted into the mounting portions 43A of the movable retainer 40 in the above-mentioned array direction and are secured in place therein (see also FIG. 4). Said mountable portions 54A have press-fit projections 54A-1 formed at the bottom edge thereof, with said press-fit projections 54A-1 adapted to enter the bottom interior wall surface of the mounting portions 43A when press-fitted into the mounting portions 43A. In this manner, in the present embodiment, press-fitting the mountable plate portions 54A of the sheet metal member 50 into the mounting portions 43A of the movable retainer 40 in the above-mentioned array direction allows for said sheet metal member 50 to be readily mounted to the movable retainer 40.

As can be seen in FIG. 3, the coupling member 60 is formed by bending a sheet metal member in the through-thickness direction and has two lateral plate portions 61 that extend in the array direction of the connection elements 10 and multiple bottom plate portions 62 that extend in the connector-width direction and couple said two lateral plate portions 61. The lateral plate portions 61 of said coupling member 60 are secured to the hereinafter-described lateral walls 71 of the support 70 using unitary co-molding.

As can be seen in FIG. 3, the lateral plate portions 61 are positioned in alignment with the two ends of the connection elements 10 in the connector-width direction and have a plate-like configuration with major faces perpendicular to the connector-width direction. Said lateral plate portions 61 have upright pieces 61A rising upwardly from the top edges of said lateral plate portions 61 formed in the above-mentioned array direction at locations corresponding to the connection elements 10, with said upright pieces 61A adapted to enter the groove portions 43B (see FIG. 4) of the movable retainer 40 of the connection elements 10 from below. The lateral plate portions 61, which are disposed to cover a portion of the lateral faces of the connector element 10, serve as shielding plates.

As can be seen in FIG. 3, FIG. 6, and FIG. 7, the bottom plate portions 62 are positioned in the above-mentioned array direction between pairs of connection elements (two paired connection elements) or between a single connection element 10 located at one end in the above-mentioned array direction (at the left end in FIG. 7) and the hereinafter-described first end wall 72 of the support 70. The thus disposed bottom plate portions 62 serve as shielding plates. Said bottom plate portions 62 have horizontal plate portions 62A whose major faces are perpendicular to the vertical direction, and vertical plate portions 62B, which are bent from the two lateral edges of said horizontal plate portions 62A extending in the connector-width direction and which extend downwardly. In other words, as can be seen in FIG. 7, the cross-sectional shape of the bottom plate portions 62 in a plane perpendicular to the connector-width direction has a downwardly open substantially inverted U-shaped configuration consisting of one horizontal plate portion 62A and two vertical plate portions 62B. However, as can be seen in FIG. 7, in the cross-sectional shape of the bottom plate portions 62 provided at the above-mentioned end in the above-mentioned array direction, the left half of the above-mentioned substantially inverted U-shaped bottom plate portions 62 is omitted.

As can be seen in FIG. 3, the vertical plate portions 62B have formed therein engagement openings 62B-1 used for engaging with the protrusions 32 of the stationary retainer 30 at two locations in the connector-width direction such that said openings pass through said vertical plate portions 62B in their through-thickness direction. As can be seen in FIG. 6 and in FIG. 7, the bottom plate portions 62 are located at the same height as the stationary retainer 30 in the vertical direction and the vertical plate portions 62B of said bottom plate portions 62 are located in close proximity to the lateral faces of the stationary retainer 30. The coupling member 60 is adapted to be mounted to the connector element 10 by engaging the engagement openings 62B-1 of the vertical plate portions 62B with the protrusions 32 of the stationary retainer 30.

The support 70, which has a square frame-like configuration when viewed in the vertical direction, as can be seen in FIG. 3, has two lateral walls 71 that extend in the array direction of the connector elements 10 and end walls 72, 73 (first end wall 72 and second end wall 73) that extend in the connector-width direction and couple the ends of said two lateral walls 71. As can be seen in FIG. 1, the inner half of the lateral walls 71 in the wall thickness direction (X-axis direction) has formed therein inner wall portions 71A extending throughout the entire range in the array direction of the connector elements (Y-axis direction). In addition, as can be seen in FIG. 1, recessed portions 71B, which are recessed into the exterior surface of said lateral walls 71 and pass therethrough in the vertical direction, are formed at spaced intervals at multiple locations in the above-mentioned array direction in the outer half of the lateral walls 71 in the wall thickness direction, and vertically extending lateral pillar portions 71C are formed between adjacent recessed portions 71B. Said lateral pillar portions 71C extend to locations above the upper faces of the inner wall portions 71A.

The end walls 72, 73 differ in shape from one another. As can be seen in FIG. 3, the first end wall 72, which is located on side Y2 in the array direction (Y-axis direction) of the connector elements 10, has the same height dimensions (vertical dimensions) throughout its entire range in the connector-width direction. As can be seen in FIG. 7, in its inner half (section on side Y1) in the wall thickness direction (Y-axis direction), the upper end of said first end wall 72 has formed therein guiding portions 72A sloping downwardly toward receiving portions R1 (side Y1). Said guiding portions 72A are adapted to guide the hereinafter-described second end wall 173 of the intermediate connector 3 to the above-mentioned receiving portions R1 in the process of connector mating.

As can be seen in FIG. 3, the second end wall 73 has a recess in the central area of its upper end face in the connector-width direction. In the sections located on both sides of said central area in the connector-width direction, there are formed guided portions 73A whose upper ends have a tapered configuration when viewed in the connector-width direction. In the process of connector mating, said guided portions 73A are adapted to be guided by the connector elements 110 and the first end wall 172 of the intermediate connector 3 described below to the hereinafter-described receiving portion R3A formed therebetween.

The connector 1 of this configuration is manufactured in the following manner. First, a line of terminals 20 arranged in the connector-width direction are unitarily co-molded with the stationary retainer 30 and the movable retainer 40 such that the terminals 20 are secured in place by said stationary retainer 30 and said movable retainer 40. Next, the sheet metal member 50 is mounted to the movable retainer 40 by press-fitting the mountable plate portions 54A of the sheet metal member 50 into the mounting portions 43A of said movable retainer 40 in the X-axis direction, thereby completing the assembly of the connector element 10. A plurality of said connector elements 10 are manufactured (nine in the present embodiment).

Next, simultaneously with molding the support 70, the lateral plate portions 61 of the coupling member 60 are secured to the lateral walls 71 of said support 70 by unitary co-molding.

Next, the multiple connector elements 10 are mounted to the coupling member 60 from above. Specifically, along with inserting the upright pieces 61A of said coupling member 60 into the groove portions 43B of the movable retainers 40 of the connector elements 10 corresponding to said upright pieces 61A, the protrusions 32 of the stationary retainers 30 are brought into engagement with the engagement openings 62B-1 of said coupling member 60. This completes the manufacture of the connector 1. In said connector 1, the support 70 supports multiple connector elements 10 through the medium of the coupling member 60.

Since the connector 2 has exactly the same shape as the connector 1 discussed above, the configuration of each component of said connector 2 will not be further discussed herein and these components will be assigned the same reference numerals as their counterparts in the connector 1.

The configuration of the intermediate connector 3 will be discussed next. Said intermediate connector 3 is formed in a substantially rectangular parallelepiped-like external configuration that extends in the longitudinal direction (Y-axis direction) coinciding with the array direction of the connector elements 10 and has larger vertical dimensions than the connectors 1, 2. Said intermediate connector 3 has the same configuration as connector 1 on the bottom side as well as on the top side, such that mating portions are formed on both the bottom and top sides. In this manner, the intermediate connector 3, which has two mating portions, has its lower mating portion mated with the connector 1 and its top mating portion mated with the intermediate connector 4 (see FIG. 2).

In the intermediate connector 3, the shape of the hereinafter-described connector elements 110 and the support 170 is different from the shape of the connector elements 10 and the support 70 of the connector 1, and the hereinafter-described coupling member 160 has the same shape as the coupling member 60 of the connector 1. Here, each component of the intermediate connector 3 is assigned reference numerals obtained by adding "100" to the reference numerals of the corresponding portions of the connector 1 (for example, the reference numeral of the terminals is "120" and the reference numeral of the lateral walls of the support is "171").

The intermediate connector 3 is constructed such that an assembly, in which connector elements 110 arranged in the same manner as in the connector 1 are mounted to the coupling member 60, is supported at the respective locations of the bottom portion of the bottom support 170 and the top portion of the upper support 170 described hereinbelow. In said intermediate connector 3, in its respective bottom and top mating portions, the spaces between two pairs of connector elements 110 adjacent in the above-mentioned array direction, and, furthermore, the spaces between the connector element 110 disposed at an outermost position in the above-mentioned array direction and the hereinafter-described end walls 172, 173 of the support 170 receive the connector elements of the counterpart connectors, with which they are mated. Specifically, in the bottom mating portion, the connector elements 10 of the connector 1 are adapted to be received in the downwardly open receiving portion R3A, and in the top mating portion, the connector elements 110 provided in the bottom portion of the intermediate connector 4 are adapted to be received in the upwardly open receiving portion R3B (see FIGS. 7 and 8).

As can be seen in FIG. 7, in the connector elements 110 of the intermediate connector 3, the configuration of the bottom and top mating portions is similar to the configuration of the connector elements 10 of the connector 1. Specifically, the connector elements 110 are configured such that, along with disposing the two connector elements 10 of the connector 1 in a mutually symmetrical orientation in the vertical direction, these two connector elements 10 extend and connect for greater mutual proximity in the vertical direction (see FIG. 7).

The intermediate terminals 120 of said connector elements 110 are shaped such that the terminals 20 of the connector 1, which are oriented in a symmetrical manner in the vertical direction, extend and connect as they approach each other in the vertical direction (see FIG. 7). Accordingly, said intermediate terminals 120 do not have connecting portions intended for connection to the circuit board and have contact portions 122 formed at their respective lower and upper ends. In addition, sections coupling a pair of contact portions 122 form intermediate retained portions 123 corresponding to the lower retained portions 23 in the terminals 20 of the connector 1. In said intermediate retained portions 123, stationary-side retained portions 123B corresponding to the stationary-side retained portions 23B of the lower retained portions 23 of the connector 1 are formed in a rectilinear configuration longer than said stationary-side retained portions 23B in the vertical direction. It should be noted that the section of the intermediate terminals 120 exclusive of the stationary-side retained portion 123B is formed such that it has the same shape and dimensions as the corresponding section in the terminals 20 of the connector 1.

The stationary retainer 130 is shaped such that the stationary-side retaining portions 31 of the stationary retainer 30 of the connector 1, which are oriented in a symmetrical manner in the vertical direction, extend and connect as they approach each other in the vertical direction (see FIG. 7). As can be seen in FIG. 7, said stationary retainer 130 extends over the range of the stationary-side retained portion 123B of the intermediate terminals 120 in the vertical direction, and, in the array direction (Y-axis direction) of the connector elements 110, the vertically intermediate portion is formed with smaller dimensions than other portions (upper and lower end). Said stationary retainer 130 secures the stationary-side retained portion 123B in place throughout its entire length using unitary co-molding.

The movable retainers 140 and the sheet metal member 150 located in the top and bottom portions of the intermediate connector 3 are formed with the same shape and dimensions as the movable retainer 40 and the sheet metal member 50 of the connector 1.

The intermediate connector 3 has two supports 170. As can be seen in FIGS. 1, 2 and 7, the two said supports 170 are disposed in a symmetrical orientation in the vertical direction. Each support 170 is shaped such that the bottom portion of the support 70 of the connector 1 illustrated in FIG. 1 extends downwardly. As can be seen in FIG. 1, in the same manner as the support 70 of the connector 1, the supports 170 have two lateral walls 171 and two end walls 172, 173 (first end wall 172 and second end wall 173). As can be seen in FIG. 1, immediately prior to connector mating, the intermediate connector 3 is disposed such that first end wall 172 is located on side Y1 and the second end wall 173 is located on side Y2 in the array direction (Y-axis direction) of the connector elements 110. Therefore, the first end wall 172 is located directly above the second end wall 73 of the connector 1, and the second end wall 173 is located directly above the first end wall 72 of the connector 1.

The intermediate connector 3 is manufactured in substantially the same manner as previously discussed with regard to the connector 1. First, a line of intermediate terminals 120 arranged in the connector-width direction are unitarily co-molded with the stationary retainer 130 and the two movable retainers 140 such that the intermediate terminals 120 are secured in place by said stationary retainer 130 and said movable retainers 140. Next, the sheet metal member 150 is mounted to the movable retainer 140 by press-fitting the mountable plate portions of the sheet metal member 150 into the mounting portions of each movable retainer 140 in the X-axis direction, thereby completing the assembly of the connector element 110. A plurality of said connector elements 110 are manufactured (nine in the present embodiment).

Next, when the support 170 is molded, the lateral plate portions 161 of the coupling member 160 are secured to the lateral walls 171 of said support 170 by unitary co-molding, thereby producing an assembly of the coupling member 160 and the support 170. Two such assemblies are provided, with the top half of the connector elements 110 mounted to one assembly and the bottom half of the connector elements 110 mounted to the other assembly, thereby producing the intermediate connector 3.

Since the intermediate connector 4 has exactly the same shape as the previously described intermediate connector 3, the configuration of each component of said intermediate connector 4 will not be further discussed herein and these components will be assigned the same reference numerals as the corresponding sections in the intermediate connector 3.

The operation of connector mating will be described next. First, the respective terminals 20 of connector 1 and connector 2 are respectively mounted to the mounting faces of the corresponding circuit boards (not shown). Specifically, the connecting portions 21S of the signal terminals 20S are solder-connected to signal circuitry and, furthermore, the connecting portions 21G of the ground terminals 20G are solder-connected to grounding circuitry.

As can be seen in FIG. 7, before connector mating, in connector 1 and intermediate connector 3, the terminals 20, 120 of the connector elements 10, 110 are bent in the flexible portions (see flexible portions 23D of the terminals 20 illustrated in FIG. 5) and said connector elements 10, 110 are deflected in a portion of the movable retainers 40, 140 in the array direction of the connector elements 10, 110 (X-axis direction) toward the receiving portions R1, R3A.

Next, as illustrated in FIGS. 1 and 7, with the connector elements 10 deflected in this portion of the movable retainer 40, the intermediate connector 3 is placed above the connector 1 such that the connector elements 110 of said intermediate connector 3 are positioned directly above the receiving portions R1 of the connector 1 and, at the same time, the connector elements 10 of the connector 1 are positioned directly below the receiving portions R3A of the intermediate connector 3. At this point, the connector 1 and intermediate connector 3 are disposed such that the first end wall 72 faces the second end wall 173, and the second end wall 73 faces the first end wall 172. Said intermediate connector 3 is then lowered without changing its orientation. When said intermediate connector 3 is lowered, the connector elements 110 of said intermediate connector 3 enter the receiving portions R1 of the connector 1 from above and, in addition, the connector elements 10 of the connector 1 enter the receiving portions R3A of the intermediate connector 3 from below.

In addition, in the connector 1, the bottom portion of the second end wall 173 of the intermediate connector 3 enters the receiving portion R1 formed between the first end wall 72 and the connector element 10 located on the left end in FIG. 7 from above (see FIG. 8). Since in the present embodiment the distal end (free end) of the biasing portion 53 of the connector element 10 is located within the holding portion 44 of the movable retainer 40 (see also FIG. 6), when the above-mentioned second end wall 173 enters the above-mentioned receiving portion R1, said second end wall 173 does not abut against the distal end of the biasing portion 53 from above and damage due to the buckling of said biasing portion 53 is reliably avoided.

Upon the complete entry of the connector elements 110 into receiving portions R1 and the connector elements 10 into receiving portions R3A, the mutually corresponding connector elements 10 and connector elements 110 become electrically connected. In other words, as can be seen in FIG. 8, along with bringing the protruding contact point portions 22A-1 of the terminals 20 of connector 1 in contact with the leaf contact point portions 122B (corresponding leaf contact point portions aligned with the terminals 20) of the intermediate terminals 120 of intermediate connector 3, the leaf contact point portions 22B of the terminals 20 of connector 1 are brought in contact with the protruding contact point portions 122A-1 (corresponding protruding contact point portions aligned with the terminals 20) of the intermediate terminals 120 of intermediate connector 3 under contact pressure. It should be noted that from the standpoint of the intermediate terminals 120, the protruding contact point portions 22A-1 of the terminals 20 of connector 1 are the corresponding protruding contact point portions and the leaf contact point portions 22B are the corresponding leaf contact point portions.

In this manner, under the action of the above-mentioned contact pressure, the terminals 20 of connector 1 and the intermediate terminals 120 of intermediate connector 3 are brought in contact while pushing against each other, and, as can be seen in FIG. 8, under the action of the reaction force generated between the terminals 20, 120, the initial flexure in the flexible portions of these terminals 20, 120 in the connector elements 10 of the connector 1 and the connector elements 110 of the intermediate connector 3 is reduced and the deflected orientation of the movable retainers 40, 140 existing prior to connector mating is corrected.

At this point, adjacent pairs of connector elements 10 in the connector 1 permit correction of the orientation of the above-mentioned movable retainer 40 as a result of mutual application of pressure and resilient displacement by the biasing protrusions 53A of the respective biasing portions 53. The reaction force originating between said biasing portions 53 is balanced with the contact force due to the contact pressure between the contact portions of the terminals 20 (see FIG. 9). In addition, in the case of connector elements 10 located at the outermost positions in the array direction of the connector elements 10, the biasing portions 53 use the biasing protrusions 53A to apply pressure to the interior wall surface of the end walls of the intermediate connector 3 and undergo resilient displacement, thereby permitting correction of the orientation of the above-described movable retainer 40. Furthermore, the reaction force received by the biasing portions 53 from the interior wall surface of the above-mentioned end walls is balanced with contact force due to the contact pressure generated between the contact portions 22 of the terminals 20 and the contact portions 122 of the intermediate terminals 120 (see FIG. 8). In addition, in the intermediate connector 3, the same principles as those described for connector 1 allow for correcting the orientation of the movable retainers 140 and, furthermore, the reaction force acting on the biasing portions 153 is balanced with the contact force due to the contact pressure between the contact portions 122 of the intermediate terminals 120 and the contact portions 22 of the terminals 20.

As discussed before, in the present embodiment, the top portion of the ground portion 51 of the sheet metal member 50 in connector 1 is formed within a range comprising the protruding contact point portions 22A-1 of the terminals 20 in the vertical direction and is in close proximity to the movable-side retaining portion 41 of the movable retainer 40 (see also FIG. 6). Therefore, when the biasing portions 53 are acted upon by the above-mentioned reaction force, a major face of the above-mentioned top portion of the ground portion 51 is urged against the wall surface of the movable-side retaining portion 41. As a result, the contact pressure between the protruding contact point portions 22A-1 located within the range of said top portion and the leaf contact point portions 122B of the intermediate terminals 120 is increased, and a stable state of contact between the terminals is adequately maintained. In addition, in the intermediate connector 3, the same principles as those described for connector 1 allow for the contact pressure between the protruding contact point portions 122A-1 and the leaf contact point portions 22B of the terminals 20 to be increased, thereby maintaining an adequate stable state of contact between the terminals.

In addition, in a mated state, as can be seen in FIG. 2, the lateral pillar portions 171C of the lower support 170 of the intermediate connector 3 enter the recessed portions 71B of the support 70 of connector 1 from above and, at the same time, the lateral pillar portions 71C of the above-mentioned support 70 enter the recessed portions 171B of the above-mentioned lower support 170 from below, as a result of which the lateral walls 71 of the support 70 and the lateral walls 171 of the lower support 170 become engaged with one another in the connector-width direction and in the array direction of the connector elements 10, 110.

In this manner, after mating the connector 1 and the intermediate connector 3, the intermediate connector 4 is mated with the intermediate connector 3 from above in the same manner. Furthermore, in the same manner, the connector 2 mounted to the mounting face of a circuit board is mated with the intermediate connector 3 from above. As a result, the connectors 1 and 2 mounted to the mounting faces of circuit boards are electrically connected via the intermediate connectors 3, 4 (see FIG. 2), thereby completing the connector mating operation. In the present embodiment, the connector 1 and the intermediate connector 3 are connected first, and the intermediate connector 4 and the connector 2 are connected after that. However, the order in which the connectors are connected is not limited to the above and any order is acceptable as long as both connector 1 and connector 2 are connected via the intermediate connectors 3 and 4.

Figure 9:
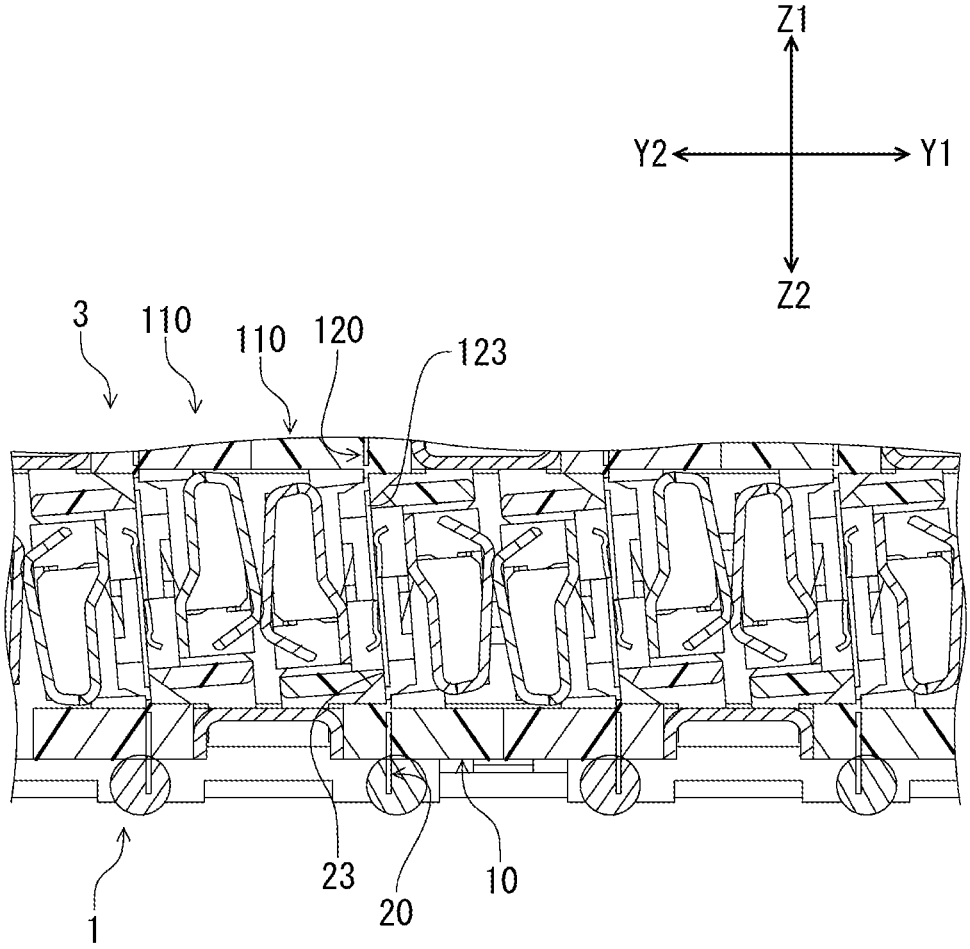
FIG. 9 A cross-sectional view illustrating the connector and intermediate electrical connector of FIG. 8 in a state of floating.

In addition, after mating or before mating the connectors, the respective circuit boards may be positioned with an offset from the regular position in the array direction of the connector elements 10. In such a case, in the present embodiment, two connector elements, which have contact pressure generated by the contact portions of the terminals of the mutually mated connectors, maintain an excellent state of contact between the contact portions in a so-called "floating" state, wherein flexure is generated in the flexible portions of the respective terminals proportionally to the amount of the above-mentioned offset, and this offset is absorbed (see FIG. 9). FIG. 9 is a cross-sectional view illustrating the floating state of the connector 1 and intermediate connector 3, as well as the floating state of the intermediate connector 3 and intermediate connector 4 in the electrical connector assembly according to the present embodiment. FIG. 9 shows a cross-section of a portion of the connector 1 and intermediate connectors 3 and 4 taken in a plane perpendicular to the connector-width direction coinciding with the locations of signal terminals in the connector-width direction. It should be noted that in FIG. 9, cross-hatching in the cross-section of the terminals of each connector was omitted.

Although in the present embodiment the ground portion of the sheet metal member is formed extending over the entire terminal array range in the connector-width direction, as an alternative, the ground portion may be formed to include only part of the terminal array range in the connector-width direction.

Although in the present embodiment two circuit boards are connected via two intermediate connectors, the number of provided intermediate connectors is not limited thereto and may be determined depending on the distance between the circuit boards configured for different products, i.e., it may be one or three and more connectors. Thus, in the present embodiment, the number of the intermediate connectors is increased or reduced depending on the configured distance between the circuit boards, thereby making it possible to easily address the requirements of various products. In addition, the electrical connectors can be easily manufactured because there is no need to increase the individual height dimensions (dimensions in the above-mentioned direction of connection) of the connectors for circuit boards and the intermediate connectors.

DESCRIPTION OF THE REFERENCE NUMERALS

1, 2 Connectors
3, 4 Intermediate connectors
10, 110 Connector elements
20 Terminal
21 Connecting portion
22, 122 Contact portions
22A-1, 122A-1 Protruding contact point portions
22B, 122B Leaf contact point portions

23D Flexible portion
30, 130 Stationary retainers
40, 140 Movable retainers
50, 150 Sheet metal members (biasing members)
53, 153 Biasing portions
70, 170 Supports
120 Intermediate terminal

The invention claimed is:

1. An intermediate electrical connector, which is disposed between one electrical connector for circuit boards disposed on a circuit board and another electrical connector for circuit boards disposed on another circuit board and which is configured to connect to the one electrical connector for circuit boards and the another electrical connector for circuit boards in a direction of connection coinciding with the direction of diametrical opposition of the circuit board and the another circuit board, comprising:

a plurality of connector elements arranged in an array direction parallel to a mounting face of the circuit board and a support supporting the plurality of connector elements;

the connector elements comprising terminals extending in the direction of connection, and stationary retainers and movable retainers made of an electrically insulating material that secure said terminals in place;

the terminals, at the respective two ends of said terminals in the longitudinal direction, comprise contact portions contactable with the terminals of the electrical connectors for circuit boards, and said respective contact portions are secured in place on one lateral face of the individual movable retainers and are secured in place by the stationary retainers between two movable retainers; and the contact portions of the terminals of the intermediate electrical connector have leaf contact point portions extending in the direction of connection and protruding contact point portions located closer to the free ends of the terminals than to said leaf contact point portions; and, in a connected state, the protruding contact point portions are made contactable with the corresponding leaf contact point portions extending in the direction of connection that are formed on the terminals of the electrical connectors for circuit boards, and, at the same time, the leaf contact point portions are made contactable with the corresponding protruding contact point portions located closer to the free ends of said terminals than to the corresponding leaf contact point portions that are formed on the terminals of the electrical connectors for circuit boards.

2. The intermediate electrical connector according to claim 1, wherein the terminals have flexible portions formed between the above-mentioned movable retainers and the respective above-mentioned stationary retainers.

3. The intermediate electrical connector according to claim 1, wherein the above-mentioned movable retainers are provided with biasing members on the lateral face opposite to the face on which the contact portions are provided, and in a connected state, the biasing members are adapted to apply pressure to other adjacent connector elements with a biasing force, as a result of which their reaction force brings the contact portions in contact with the terminals of the electrical connectors for circuit boards under a certain contact pressure.

4. An electrical connector assembly, wherein the assembly comprises a plurality of intermediate electrical connectors, each of the intermediate electrical connectors being disposed between one electrical connector for circuit boards disposed on a circuit board and another electrical connector for circuit boards disposed on another circuit board and which is configured to connect to the one electrical connector for circuit boards and the another electrical connector for circuit boards in a direction of connection coinciding with the direction of diametrical opposition of the circuit board and the another circuit board, each of the intermediate electrical connectors comprising:

a plurality of connector elements arranged in an array direction parallel to a mounting face of the circuit board and a support supporting the plurality of connector elements;

the connector elements comprising terminals extending in the direction of connection, and stationary retainers and movable retainers made of an electrically insulating material that secure said terminals in place;

the terminals, at the respective two ends of said terminals in the longitudinal direction, comprise contact portions contactable with the terminals of the electrical connectors for circuit boards, and said respective contact portions are secured in place on one lateral face of the individual movable retainers and are secured in place by the stationary retainers between two movable retainers; and the contact portions of the terminals of the intermediate electrical connector have leaf contact point portions extending in the direction of connection and protruding contact point portions located closer to the free ends of the terminals than to said leaf contact point portions; and, in a connected state, the protruding contact point portions are made contactable with the corresponding leaf contact point portions extending in the direction of connection that are formed on the terminals of the electrical connectors for circuit boards, and, at the same time, the leaf contact point portions are made contactable with the corresponding protruding contact point portions located closer to the free ends of said terminals than to the corresponding leaf contact point portions that are formed on the terminals of the electrical connectors for circuit boards, and wherein said intermediate electrical connectors are capable of connecting pairs of said intermediate electrical connectors.

5. An electrical connector assembly comprising an intermediate electrical connector, which is disposed between one electrical connector for circuit boards disposed on a circuit board and another electrical connector for circuit boards disposed on another circuit board and which is configured to connect to the one electrical connector for circuit boards and the another electrical connector for circuit boards in a direction of connection coinciding with the direction of diametrical opposition of the circuit board and the another circuit board, and either of the electrical connectors for circuit boards from among said electrical connector for circuit boards and the another electrical connector for circuit boards, wherein the electrical connector for circuit boards, the another connector for circuit boards, and the intermediate electrical connector each comprise:

a plurality of connector elements arranged in an array direction parallel to the mounting faces of the circuit boards and a support supporting the plurality of connector elements, and the connector elements have terminals extending in direction of connection, as well as stationary retainers and movable retainers of an electrically insulating material that hold said terminals in place;

the terminals of the electrical connector for circuit boards and the another electrical connector for circuit boards having connecting portions connectable to the mounting faces at one end of said terminals in the longitudinal direction of the terminals and contact portions contactable with the terminals of the intermediate electrical connector at the other end in the longitudinal direction; said contact portions being secured in place on one lateral face of the movable retainers and secured in place by the stationary retainers between said movable retainers and the above-mentioned connecting portions;

the terminals of the intermediate electrical connector have contact portions contactable with the terminals of the electrical connectors for circuit boards in the respective two end portions of said terminals in the longitudinal direction, with said respective contact portions being secured in place on one lateral face of the individual movable retainers and secured in place between two movable retainers by the stationary retainers; and the contact portions of the terminals of the circuit board connectors and the intermediate electrical connector have leaf contact point portions extending in the above-mentioned direction of connection and protruding contact point portions located closer to the free end side of the terminals than to said leaf contact point portions; and, in a connected state, the protruding contact point portions of the above-mentioned terminals are made contactable with the leaf contact point portions of the counterpart terminals.

6. The electrical connector assembly according to claim 5, wherein the terminals of the electrical connectors for circuit boards have flexible portions formed between the stationary retainers and movable retainers that secure said terminals in place, and the terminals of the intermediate electrical connector are adapted to have flexible portions formed between the respective stationary retainers and the movable retainers that secure said terminals in place.

7. The electrical connector assembly according to claim 5, wherein the movable retainers of the electrical connectors for circuit boards and the intermediate electrical connector have biasing members provided on the lateral faces opposite to the faces on which the contact portions are provided, and in a connected state, the above-mentioned biasing members are adapted to apply pressure to other adjacent connector elements with a biasing force, such that their reaction force brings the contact portions in contact with the counterpart terminals under a certain contact pressure.

8. The electrical connector assembly according to claim 5 wherein a plurality of intermediate electrical connectors is provided and said intermediate electrical connectors are capable of connecting pairs of said intermediate electrical connectors.

9. An electrical connector assembly in which one electrical connector for circuit boards disposed on a circuit board and another electrical connector for circuit boards disposed on another circuit board can be connected via an intermediate electrical connector disposed between the two electrical connectors for circuit boards in a direction of connection coinciding with the direction of diametrical opposition of the two circuit boards, wherein:

the two electrical connectors for circuit boards and the intermediate electrical connector comprise a plurality of connector elements arranged in an array direction parallel to the mounting faces of the circuit boards and a support supporting the above-mentioned plurality of connector elements, with the above-mentioned connector elements having terminals that extend in the above-mentioned direction of connection, as well as stationary retainers and movable retainers of an electrically insulating material that secure said terminals in place;

the terminals of the two electrical connectors for circuit boards have connecting portions connectable to the mounting faces at one end of said terminals in the longitudinal direction and contact portions contactable with the terminals of the intermediate electrical connector at the other end in the longitudinal direction, with said contact portions being secured in place on one lateral face of the movable retainers and secured in place by the stationary retainers between said movable retainers and the above-mentioned connecting portions;

the terminals of the intermediate electrical connector have contact portions contactable with the terminals of the electrical connectors for circuit boards at the respective two ends of said terminals in the longitudinal direction, with said respective contact portions being secured in place on one lateral face of the individual movable retainers and secured in place between two movable retainers by the stationary retainers; and the contact portions of the terminals of the two circuit board connectors and the intermediate electrical connector have leaf contact point portions extending in the above-mentioned direction of connection and protruding contact point portions located closer to the free end side of the terminals than to said leaf contact point portions; and, in a connected state, the protruding contact point portions of the above-mentioned terminals are made contactable with the leaf contact point portions of the counterpart terminals.

10. The electrical connector assembly according to claim 9, wherein the terminals of the two electrical connectors for circuit boards have flexible portions formed between the stationary retainers and movable retainers that secure said terminals in place, and the terminals of the intermediate electrical connector are adapted to have flexible portions formed between the respective stationary retainers and the movable retainers that secure said terminals in place.

11. The electrical connector assembly according to claim 9, wherein the movable retainers of the two electrical connectors for circuit boards and the intermediate electrical connector have biasing members provided on the lateral faces opposite to the faces on which the contact portions are provided, and, in a connected state, the above-mentioned biasing members are adapted to apply pressure to other adjacent connector elements with a biasing force such that their reaction force brings the contact portions in contact with the counterpart terminals under a certain contact pressure.

12. The electrical connector assembly according to claim 9, wherein a plurality of intermediate electrical connectors is provided and said intermediate electrical connectors are capable of connecting pairs of said intermediate electrical connectors.

* * * * *